US005899567A

United States Patent [19]

Morris, Jr.

[11] Patent Number: 5,899,567

[45] Date of Patent: May 4, 1999

[54] MAGNETIC SYNCHRONIZED STIRRING AND HEATING TEST APPARATUS

[76] Inventor: Joseph E. Morris, Jr., 47 Silvergrove Crescent NW, Calgary, Alberta, Canada, T3B 4M6

[21] Appl. No.: 08/933,913

[22] Filed: Sep. 23, 1997

[51] Int. Cl.[6] ..... B01F 13/08

[52] U.S. Cl. ..... 366/274

[58] Field of Search ..... 366/144–146, 366/273–274; 416/3

[56] References Cited

U.S. PATENT DOCUMENTS

| | | | |
|---|---|---|---|
| 3,356,346 | 12/1967 | Landsberger | 366/274 |
| 3,784,170 | 1/1974 | Petersen et al. . | |
| 4,040,605 | 8/1977 | Towsend | 366/273 |
| 4,225,248 | 9/1980 | Para | 366/274 X |
| 4,477,192 | 10/1984 | Bonney | 366/274 |
| 4,752,138 | 6/1988 | Rufer | 366/274 |
| 4,759,635 | 7/1988 | MacMichael et al. | 366/274 |
| 4,876,069 | 10/1989 | Jochimsen | 366/273 X |
| 4,911,555 | 3/1990 | Saffer et al. | 366/274 |
| 4,991,973 | 2/1991 | Maaz et al. | 366/274 X |
| 5,176,446 | 1/1993 | Chiba et al. | 366/274 X |
| 5,529,391 | 6/1996 | Kindman et al. | 366/145 |
| 5,547,280 | 8/1996 | Wanninger et al. | 366/274 |

FOREIGN PATENT DOCUMENTS

| | | | |
|---|---|---|---|
| 3344754 | 6/1985 | Germany | 366/273 |
| 2082929 | 3/1982 | United Kingdom | 366/274 |

*Primary Examiner*—Charles E. Cooley

[57] ABSTRACT

An apparatus for testing a plurality of fluid samples at elevated temperatures or pressures, while providing for simultaneous stirring of the fluid samples to simulate desired fluid flow regimes. The apparatus comprises a stirrer compartment disposed within an adjustable temperature controlled and insulated enclosure. A plurality of magnetic stirring shaft assemblies are rotatably disposed within the temperature controlled and insulated enclosure in close proximity to the stirrer compartment. A plurality of pressurized sample cells containing fluid samples to be tested and magnetic stir bars can be placed on the test platform. The fluid samples can be continuously stirred in synchronized fashion by motivating the magnetic stir bars by means of synchronized rotation of the magnetic stirring shaft assemblies. Various flow regimes can be simulated by adjusting the rotational speed of the stirring shaft assemblies.

2 Claims, 1 Drawing Sheet

MAGNETIC SYNCHRONIZED STIRRING AND HEATING TEST APPARATUS

BACKGROUND OF THE INVENTION

1. Field of the Invention

The present invention relates to an apparatus for testing a plurality of fluid samples at elevated temperatures and/or pressures, while providing for simultaneous stirring of said samples to simulate desired fluid flow regimes. More specifically, the present invention relates to a temperature controlled enclosure containing multiple synchronized magnetic stirring assemblies which allow for synchronized stirring and simultaneous thermostating of one or more pressurized sample cells containing fluid samples to be tested.

2. Description of Related Art

Stirring apparatuses have been known in the art for some time. One recent example is disclosed in U.S. Pat. No. 5,547,280 to Wanninger et al., which describes a magnetic stirrer wherein a drive motor with controlling means and an electrical connection are placed in a lower part, and a glass mounting surface, which is largely impervious to aggressive liquids and vapors, comprises a top part. Said top part forms a mounting surface for a stirring container which holds a stirring magnet. The invention disclosed in Wanninger, et al, is easily distinguishable from the invention disclosed herein because it has no means to control the temperature of the samples to be tested.

An apparatus with a temperature control device is disclosed in U.S. Pat. No. 4,876,069 to Jochimsen. The Jochimsen patent discloses a blood clotting time measuring apparatus having a temperature controlled cabinet with at least one measuring port for receiving sample cells containing blood. A magnetic stirrer is mounted in the cabinet proximate to the measuring port to enable stirring of a metal ball placed inside the sample cell. However, unlike the invention disclosed herein, the Jochimsen patent does not disclose means for enclosing the entire sample to be tested. Furthermore, the Jochimsen patent does not disclose means to analyze the subject sample at elevated pressures, and envisions use of relatively small-volume samples.

Another magnetic stirring device with a temperature control mechanism is disclosed in U.S. Pat. No. 5,529,391 to Kindman, et al. The invention disclosed in Kindman relates to a magnetic stirring and heating/cooling apparatus that provides simultaneous stirring and thermostating of multiple, yet relatively small, biological samples. The apparatus disclosed in Kindman utilizes a heat conducting block which provides thermostatic temperature control. Liquid samples contained in vessels can be inserted into multiple sample wells which are bored into said heat conducting block. Multiple coils surround the lower portion of each of the multiple sample wells to provide rotating magnetic fields that motivate magnetic stirring bars which are positioned inside the sample vessels. Unlike the invention disclosed herein, the Kindman patent does not disclose means for applying pressure to the samples being tested.

Other patents of interest which disclose magnetic stirrers include U.S. Pat. No. 3,784,170 to Petersen et al.; U.S. Pat. No. 4,991,973 to Maaz et al.; U.S. Pat. No. 4,752,138 to Rufer; U.S. Pat. No. 4,759,635 to MacMichael et al.; and U.S. Pat. No. 4,830,511 to Smazik. However, none of these references disclose applicant's novel inventive apparatus which provides for simultaneous synchronized stirring and thermostating of multiple samples contained in pressurized sample cells.

SUMMARY OF THE INVENTION

With the present invention, applicant provides an apparatus comprising a temperature controlled thermal enclosure containing a test surface for receiving a plurality of pressurized sample cells containing magnetic stir bars and fluid samples to be tested. Said test surface is positioned above multiple magnetic stirring shaft assemblies. Synchronized rotation of said synchronized stirring shaft assemblies results in synchronized rotation of said magnetic stir bars contained within said pressurized sample cells, which in turn results in synchronized stirring of the samples to be tested.

The thermal enclosure is heated and insulated to control temperatures above ambient conditions. Although other means of applying heat to the samples may be contemplated, the heat source within the enclosure can be provided by one or more heating elements mounted on the internal walls of said enclosure. A temperature control device controls the heating elements to precisely maintain the temperature within the enclosure at desired levels.

The multiple magnetic stirring shaft assemblies extend to a point proximate to the base of the test surface. The multiple magnetic stirring shaft assemblies are connected, either directly or indirectly, to provide synchronized rotation of said shafts and magnets, which in turn rotate, in synchronized fashion, the magnetic stirring bars present within the pressurized sample cells. Although other means of connecting said magnetic stirring shafts may be contemplated, said stirring shafts can be connected by belt assemblies. Said belt assemblies are driven by a motor equipped with a variable speed control. By adjusting the speed of said motor, the operator can adjust the rotational speed of said magnetic stirring shaft assemblies and, thus, the stirring speed of the magnetic stir bars contained within the sample cells.

The synchronized stirring and heating test apparatus of the present invention is designed to allow for testing of multiple fluid samples at elevated temperatures and pressures. However, by adjusting the stirring speed of said magnetic stir bars, the apparatus can accommodate a wide range of characteristic fluid flow regimes (e.g. laminar, slug, turbulent, etc.) The test apparatus of the present invention is further designed to accommodate pressurized test cells which can accept electrochemical probes and inert, electrically neutral, metal coupon extensions to permit simultaneous gravimetric studies.

In its preferred embodiment, the synchronized stirring and heating test apparatus can accommodate the testing of multiple large or small-volume samples having a wide range of viscosities. Furthermore, the entire apparatus is designed to be both fire and explosion proof. The test apparatus contains no combustible internal or external components, and can be fitted with thermal resistant cable connections.

DESCRIPTION OF THE PREFERRED EMBODIMENTS

Figure 1:
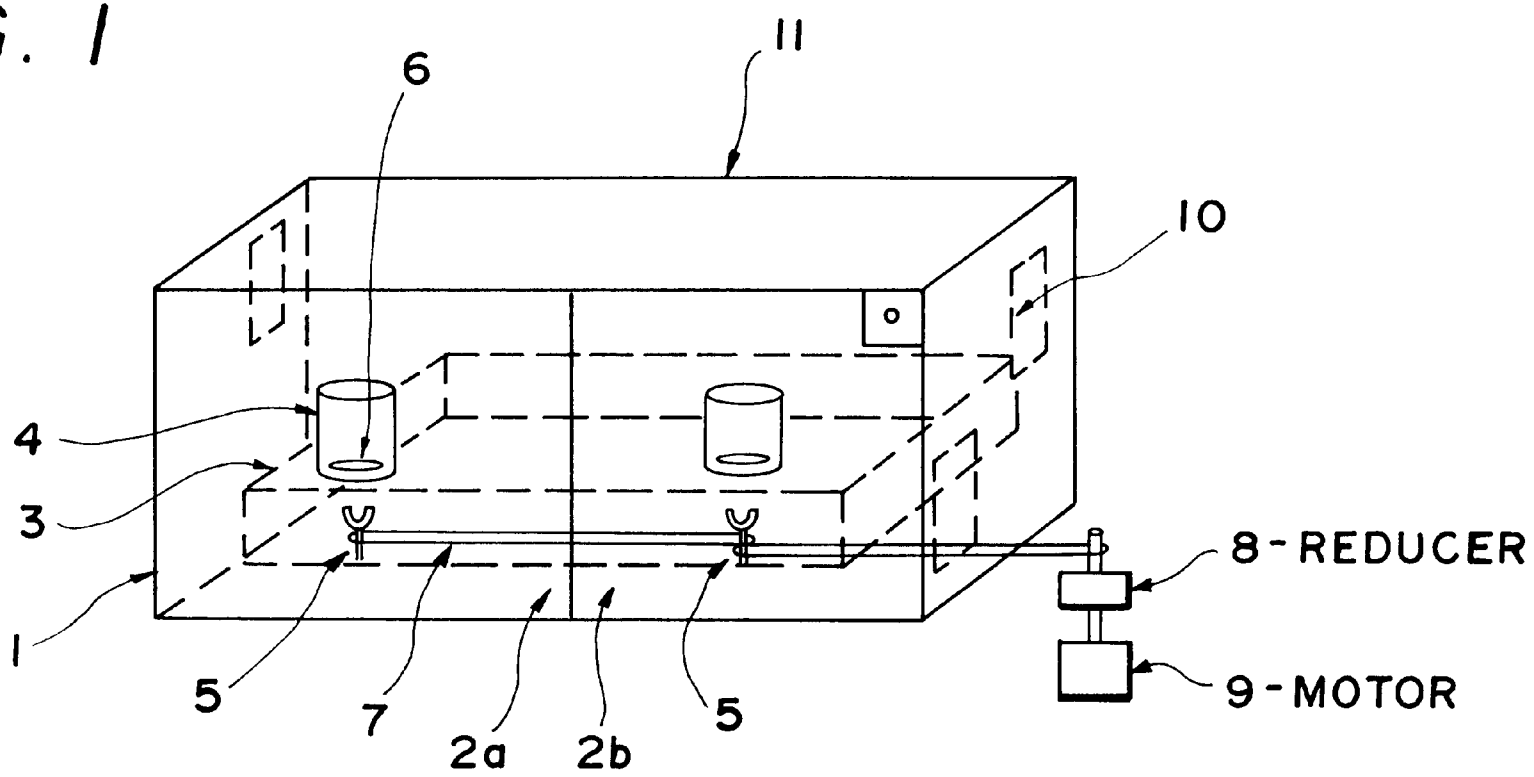
FIG. 1 is a perspective review of a synchronized stirring and heating test apparatus in accordance with the present invention.

Referring now to FIG. 1, the synchronized stirring and heating test apparatus of the invention is shown and generally designated 11. The synchronized stirring and heating test apparatus 11 comprises an external oven compartment 1 which is lined with insulating material for precise temperature control inside the compartment. The external oven compartment 1 has doors 2*a* and 2*b* for internal access.

The external oven compartment 1 contains a stirrer compartment 3 with an upper sample surface designed to support multiple pressurized test cell 4. Said stirrer compartment 3 is constructed of non-magnetic, heat and corrosion resistant material, and rests on support legs to provides clearance for multiple magnetic stirring shaft assemblies 5. The size of the stirrer compartment 3 is such that it can be easily moved in and out of the oven compartment 1. Stirrer compartment 3 is positioned so that magnetic stirring shaft assemblies 5 do not impede stirrer compartment 3 from being moved in and out of oven compartment 1. Multiple pressurized test cells 4 are received on stirrer compartment 3 proximate, to magnetic stirring shaft assemblies 5. Each pressurized test cell 4 contains magnetic stir bar 6.

Magnetic stirring shaft assemblies 5 comprise multiple magnetic stirring shafts that extend vertically beneath the sample surface of said rectangular stirrer compartment 3. The lower ends of said magnetic stirring shaft assemblies are mounted in bearing assemblies for stability and ease of rotation. The top ends of said magnetic stirring shafts are coupled with magnets and extend to a point immediately proximate to the lower surface of the stirrer compartment 3.

Each magnetic stirring shaft assembly 5 has at least one drive belt 7 connected to its shaft. Reducer 8 and motor 9 are secured to a side of external oven compartment 1, and connected to drive belt 7. A suitable power supply is wired into the motor 9. Motor 9 is further equipped with a variable speed control mechanism to provide a means for varying the level of stirring within the pressurized sample containers.

Heating elements 10 are secured to internal sides of the oven compartment 1 so as to heat the inside of the oven compartment 1 above ambient temperature as desired. A temperature sensing probe is utilized to control the temperature inside of oven compartment 1 at desired temperatures.

During operation of the synchronized stirring and heating apparatus, motor 9 is activated to turn at a desired speed. Motor 9 causes rotation, via drive belts 7, of multiple magnetic stirring shafts 5. Rotation of said multiple magnetic stirring shafts 5 causes synchronized rotation of magnetic stir bars 6 within test cells 4, resulting in synchronized stirring of fluid samples contained within test cells 4.

It is understood that various details of the invention may be changed without departing from the scope of the invention. Furthermore, the foregoing description is for the purpose of illustration only, and not for the purpose of limitation—the invention being defined by the claims.

What is claimed is the following:

1. A synchronized stirring and heating test apparatus comprising:

a. a heated and thermally insulated enclosure having a base;

b. a stirrer compartment having an upper surface and a lower surface disposed within said enclosure;

c. a plurality of stirring shaft assemblies having a top and a bottom end, wherein the bottom end of said stirring shaft assemblies are rotatably mounted to the base of said enclosure and the top end of said stirring shaft assemblies are magnetically charged and positioned proximate to the lower surface of said stirrer compartment;

d. one or more pressurized test cells received on the upper surface of said stirrer compartment;

e. magnetic stir bars disposed within said pressurized test cells;

f. a plurality of drive belts affixed to said stirring shaft assemblies; and g. a motor affixed to said drive belts.

2. The synchronized stirring and heating test apparatus of claim 1, further comprising a reducer affixed to at least one of said drive belts.

* * * * *